US011149594B2

(12) United States Patent
Tanuma

(10) Patent No.: US 11,149,594 B2
(45) Date of Patent: Oct. 19, 2021

(54) METHOD OF SETTING TAPPET CLEARANCE AND DEVICE THEREFOR

(71) Applicant: HONDA MOTOR CO., LTD., Tokyo (JP)

(72) Inventor: Naoya Tanuma, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/999,093

(22) Filed: Aug. 21, 2020

(65) Prior Publication Data

US 2021/0062684 A1 Mar. 4, 2021

(30) Foreign Application Priority Data

Aug. 26, 2019 (JP) ..... JP2019-153388

(51) Int. Cl.

| | |
|---|---|
| ***F01L 1/20*** | (2006.01) |
| ***F01L 1/16*** | (2006.01) |
| ***F01L 1/18*** | (2006.01) |
| ***F01L 1/46*** | (2006.01) |
| ***B25B 21/00*** | (2006.01) |
| ***B25B 23/00*** | (2006.01) |

(52) U.S. Cl.

CPC ..... *F01L 1/16* (2013.01); *B25B 21/002* (2013.01); *B25B 23/0064* (2013.01); *F01L 1/18* (2013.01); *F01L 1/20* (2013.01); *F01L 1/46* (2013.01); *F01L 2303/01* (2020.05)

(58) Field of Classification Search

CPC ..... F01L 1/185; F01L 1/20; F01L 1/22; F01L 2201/00; F01L 2303/01

USPC ..... 123/90.39, 90.44, 90.45, 90.54

See application file for complete search history.

(56) References Cited

U.S. PATENT DOCUMENTS

| | | | | |
|---|---|---|---|---|
| 3,988,925 | A * | 11/1976 | Seccombe | F01L 1/20 73/114.79 |
| 6,205,850 | B1 * | 3/2001 | Wehrman | F01L 1/20 73/114.79 |
| 2006/0130792 | A1 * | 6/2006 | Katou | F01L 1/20 123/90.45 |
| 2006/0288973 | A1 * | 12/2006 | Hathaway | F01L 1/146 123/90.43 |
| 2007/0266972 | A1 * | 11/2007 | Tachino | F01L 1/20 123/90.16 |
| 2008/0022956 | A1 * | 1/2008 | Matsuura | F01L 1/20 123/90.54 |

(Continued)

FOREIGN PATENT DOCUMENTS

| | | |
|---|---|---|
| JP | 62-000610 | 1/1987 |

*Primary Examiner* — Jorge L Leon, Jr.

(74) *Attorney, Agent, or Firm* — Amin, Turocy & Watson, LLP

(57) ABSTRACT

Even in the case where, due to distortion (undulation) or the like of an end surface of an adjusting screw abutting on a valve stem end, there exists a non-linear undulation movement amount in a movement amount of the end surface with respect to a rotation return angle of the adjusting screw, the undulation movement amount is continuously measured, and a screw return movement amount based on a screw pitch and on the rotation return angle is continuously calculated, and, when a total movement amount of the undulation movement amount and the screw return movement amount has attained a prescribed clearance, return rotation is ended.

9 Claims, 5 Drawing Sheets

(56) References Cited

U.S. PATENT DOCUMENTS

| | | | | |
|---|---|---|---|---|
| 2011/0061621 | A1* | 3/2011 | Finkenbiner | F01L 1/20 123/90.45 |
| 2019/0101030 | A1* | 4/2019 | Takagi | F01L 1/053 |

* cited by examiner

METHOD OF SETTING TAPPET CLEARANCE AND DEVICE THEREFOR

CROSS-REFERENCE TO RELATED APPLICATION

This application is based upon and claims the benefit of priority from Japanese Patent Application No. 2019-153388 filed on Aug. 26, 2019, the contents of which are incorporated herein by reference.

BACKGROUND OF THE INVENTION

Field of the Invention

The present invention relates to a method of setting tappet clearance and a device therefor, by which a tappet clearance between a valve stem end and an end surface of an adjusting screw screwed into an acting end of a rocker arm is set to a prescribed clearance.

Description of the Related Art

When an intake/exhaust valve of an engine extends by expanding due to heat of a combustion chamber, a valve opening time and a valve lift amount of the intake/exhaust valve change. In order that these valve opening time and valve lift amount will be optimal at a normal operating temperature of the engine, a clearance (a gap) between an end surface of an adjusting screw screwed into an acting end of a rocker arm, and a valve stem end, that is, a tappet clearance, is set.

When the tappet clearance increases, the valve opening time becomes shorter and the lift amount decreases, so that efficiency of intake/exhaust lowers. At the same time, sound generated when the valve stem end is struck by the rocker arm (tappet noise) increases. Conversely, when the tappet clearance is too small, there occurs a state where the valve is constantly pressed by the rocker arm at the normal operating temperature, and sometimes it becomes difficult for the valve to completely close.

For example, Japanese Laid-Open Patent Publication No. 62-000610 (hereafter, referred to as JPA62-000610) discloses technology relating to a method of setting tappet clearance. In this technology, first, an adjusting screw screwed into the acting end of a rocker arm is fed in by turning a screwdriver that is rotationally driven by a servomotor, and, when a place where displacement amount of the rocker arm has reached a stable region (a place where clearance=0 [mm] has been attained) is detected by a value of fastening torque, feeding-in rotation is stopped.

Next, rotation of the adjusting screw is returned, and, when a return movement amount of the adjusting screw in the axial direction thereof calculated from a screw pitch and a rotation angle of the adjusting screw, has attained a prescribed clearance, return rotation is stopped. The tappet clearance is assumed to be set at a time point (a position) that the return rotation has been stopped.

SUMMARY OF THE INVENTION

The tappet clearance is set to an optimal value characteristic of a type of the engine, and a value of the tappet clearance has an extremely narrow dimension. Therefore, a setting error with respect to the required value of the tappet clearance (clearance error) needs to be even smaller, and high precision will be required thereof.

However, the end surface (an abutting surface on the valve stem end, for example, a rounded end-processed end surface) of the adjusting screw includes therein processing distortion (alternatively referred to as undulation) or the like within a tolerance.

It has therefore been understood that, even if rotation of the adjusting screw is returned in a state where the end surface of the adjusting screw is abutting on the flat-surfaced valve stem end due to own weight of the rocker arm, and the movement amount of the adjusting screw in the axial direction thereof calculated from the screw pitch and the rotation angle of the adjusting screw has attained a calculation value corresponding to the prescribed clearance, the tappet clearance at a position of the acting end of the rocker arm (a position of the end surface of the adjusting screw) includes an error caused by the processing distortion or the like of the end surface of the adjusting screw.

Note that if a specification reducing tolerance at the end surface of the adjusting screw is adopted, distortion can be reduced, but processing will get more sophisticated, and cost of the adjusting screw itself will significantly rise, to the extent tolerance is reduced.

The present invention, which has been made in view of such problems, has an object of providing a method of setting tappet clearance and a device therefor, by which a tappet clearance is easily set to a prescribed clearance, even when there is an error generating factor such as processing distortion of an end surface of an adjusting screw.

One aspect of the present invention is a method of setting tappet clearance by which a tappet clearance between an end surface of an adjusting screw screwed into an acting end of a rocker arm, and a valve stem end, is set to a prescribed clearance, the method including: a step of starting return rotation of the adjusting screw from a position where the end surface of the adjusting screw is abutting on the valve stem end due to weight of the rocker arm on an acting end side, and a pressing torque on the valve stem end has a zero value, the return rotation being started in a state where the abutting is being continued; a step of, when rotation is being returned in the state where the abutting is being continued, continuously measuring, as an undulation movement amount, movement of the end surface of the adjusting screw in both directions in an axial direction of the adjusting screw due to undulation, and continuously calculating, as a screw return movement amount, movement based on a screw pitch in a return direction in the axial direction of the adjusting screw and on a rotation return angle; and a step of ending the return rotation of the adjusting screw when a total movement amount of the undulation movement amount and the screw return movement amount that have been continuously acquired has attained the prescribed clearance.

Another aspect of the present invention is a device that sets tappet clearance by which a tappet clearance between an end surface of an adjusting screw screwed into an acting end of a rocker arm, and a valve stem end, is set to a prescribed clearance, the device including: a screwdriver configured to rotate the adjusting screw; a return rotation starting unit configured to start return rotation of the adjusting screw by the screwdriver, from a position where the end surface of the adjusting screw is abutting on the valve stem end due to weight of the rocker arm on an acting end side, and a pressing torque on the valve stem end has a zero value, the return rotation being started in a state where the abutting is being continued; a measuring unit configured to, when rotation is being returned in the state where the abutting is being continued, continuously measure, as an undulation movement amount, movement of the end surface of the adjusting screw in both directions in an axial direction of the adjusting screw due to undulation; a return movement amount calculating unit configured to continuously calculate, as a return movement amount (screw return movement amount), movement based on a screw pitch in a return direction in the axial direction of the adjusting screw and on a rotation return angle; and a return rotation ending unit configured to end the return rotation of the adjusting screw when a total movement amount of the undulation movement amount and the return movement amount that have been continuously acquired has attained the prescribed clearance.

According to the present invention, a configuration has been adopted whereby, even in the case where, due to distortion (undulation) or the like of the end surface of the adjusting screw abutting on the valve stem end, there exists a non-linear undulation movement amount in a movement amount of the end surface of the adjusting screw from a position where pressing torque of the adjusting screw is zero, with respect to the rotation return angle of the adjusting screw, the undulation movement amount is continuously measured, and the return movement amount based on the screw pitch and the rotation return angle of the adjusting screw is continuously calculated, and, when the total movement amount of the undulation movement amount being measured and the return movement amount being calculated has attained the prescribed clearance, return rotation is ended. Therefore, the tappet clearance can be set to the prescribed clearance in a short time, easily, accurately, and reliably.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

An embodiment of a method of setting tappet clearance and a device therefor according to the present invention will be presented and described in detail below with reference to the accompanying drawings.

[Configuration]

Figure 1:
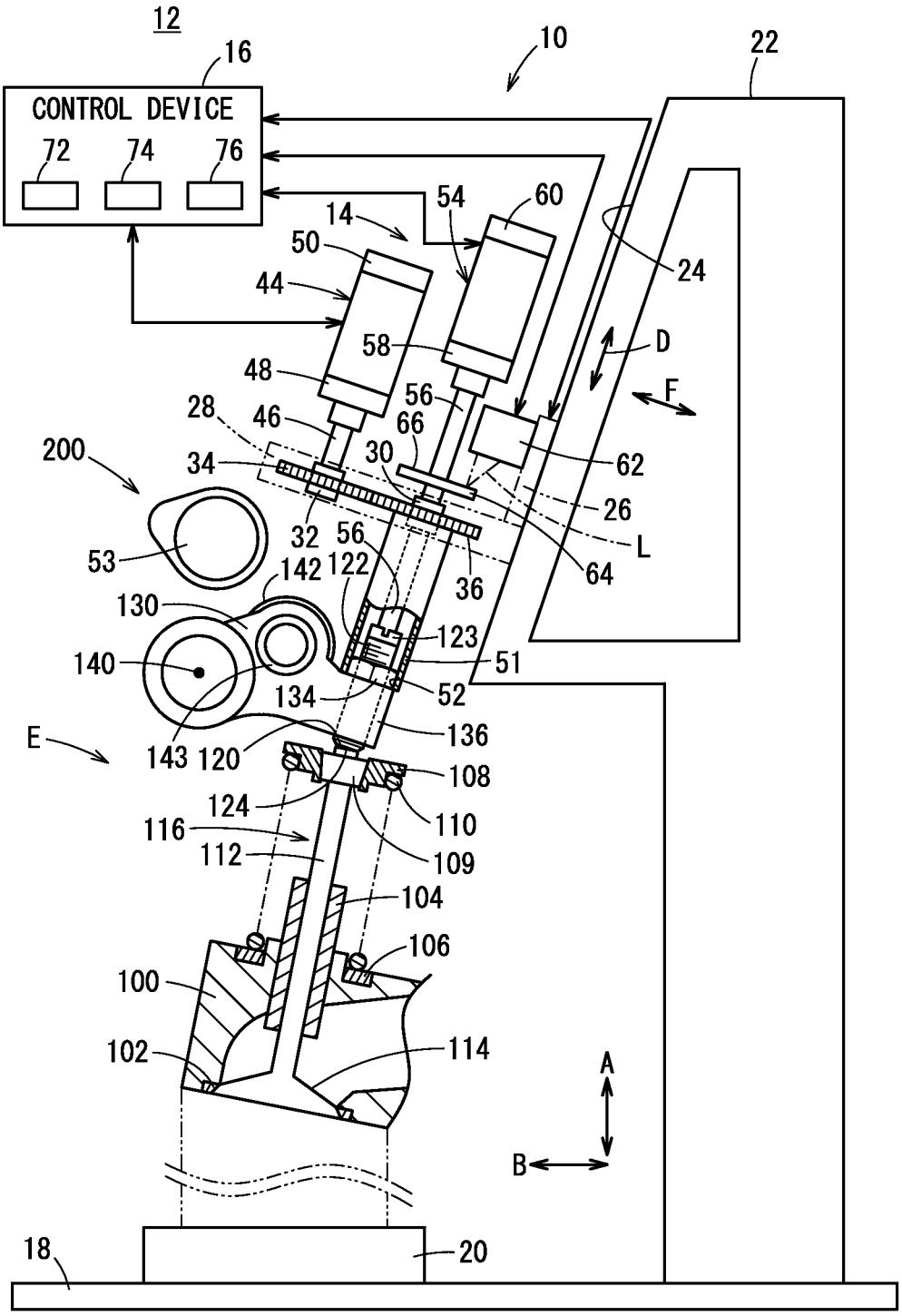
FIG. 1 is a schematic view showing an example of configuration of a tappet clearance setting system comprising a tappet clearance setting device according to an embodiment implementing a method of setting tappet clearance according to an embodiment.

FIG. 1 is a schematic view showing an example of configuration of a tappet clearance setting system 12 comprising a tappet clearance setting device 10 according to an embodiment implementing a method of setting tappet clearance according to an embodiment.

The tappet clearance setting device 10 is configured from a device main body 14, and a control device 16, such as a control panel, which controls the device main body 14.

The tappet clearance setting system 12 is configured from, in addition to the tappet clearance setting device 10, an engine conveying stand 20 which is provided on a baseplate 18 that extends in an arrow B direction (a horizontal direction), and a column 22 supporting the device main body 14 of the tappet clearance setting device 10. The column 22 may be configured by an industrial robot.

The device main body 14 is provided with a slider (a slide actuator) 26. The column 22 has an arm section 24 inclining in an arrow D direction (an inclined direction) with respect to an arrow A direction (a vertical direction), and the slider 26 is movable on the arm section 24 in the inclined direction D (arrow D direction), and is positioned on and fixedly supported by the column 22 during tappet clearance setting.

Meanwhile, an engine E which is depicted with a part thereof omitted is positioned and placed on the engine conveying stand 20.

A cylinder head 100 of the engine E is provided with a valve gear mechanism 200 that mechanically opens an intake port and an exhaust port.

A valve seat 102, a valve guide 104, and a spring seat (a valve spring seat) 106 are fastened to the cylinder head 100, and a valve spring 110 functioning as a compression spring is interposed between the spring seat 106 and a retainer 108.

Furthermore, the cylinder head 100 is provided with a valve 116. The valve 116 is configured from: a valve face 114 that opens/closes a cylinder chamber; a valve stem 112; a spacer 109 fitted to a small diameter section (not illustrated) of the valve stem 112; the retainer 108 that holds the valve stem 112 via the spacer 109; and the valve guide 104 that guides the valve stem 112.

The valve stem 112 is movable in an axial direction of the valve stem 112 by being guided by the valve guide 104 in a state of being held by the retainer 108. In this case, the valve face 114 is configured capable of seating on the valve seat 102 when the valve 116 is closed.

A valve stem end 120 of the valve stem 112 projects to an upper side of the retainer 108.

The valve stem end 120 which is processed into a flat surface is faced by an end surface (in terms of specification, for example, a spherical surface-finished convex surface, a rounded end surface) 124 of an adjusting screw 122 abutting on the valve stem end 120 at a time of intake/exhaust.

The adjusting screw 122 is screwed into a screw groove of an acting end 136 of a rocker arm 130, and is fixed to the acting end 136 of the rocker arm 130 by a lock nut 134 when a tappet clearance has been set to a prescribed clearance.

The valve gear mechanism 200, which is of end pivot type (swing arm type), is configured from: a cam 53 that moves in conjunction with rotation of a crankshaft (unillustrated); the rocker arm 130 that rocks via a roller 142 with rotation of the cam 53; and the valve 116 that moves linearly and is opened/closed via the end surface 124 of the adjusting screw 122 with rocking of the rocker arm 130.

The rocker arm 130 comprises, in addition to the acting end 136 into which the adjusting screw 122 is screwed, a pivot shaft 140 (a fulcrum end), and a roller shaft 143 that supports the roller 142 (a force application point) to which rocking of the cam 53 is transmitted.

The D direction depicted in the column 22 is a direction of an inclined surface of the arm section 24 parallel to an axial direction of the adjusting screw 122.

The slider 26 is provided with a gear storage section 28 which is configured integrally with the slider 26 and extends in an F direction orthogonal to the D direction.

In the gear storage section 28, a rolling bearing 30 and a spline bearing 32 are provided in parallel in an arrow F direction, and a gear 36 fitted to an outer ring of the rolling bearing 30 and a gear 34 fitted to an outer surface of the spline bearing 32 are configured so as to mesh with each other.

An upper end side of a cylindrical socket 51 that rotates integrally with the gear 36, is fastened to a bottom surface on a D direction downward side of the gear 36, and an engaging section 52 capable of engaging with the lock nut 134 is provided to a lower end side inner circumferential surface of the socket 51.

A spline shaft of the spline bearing 32 is rotatably attached to a rotating shaft 46 of a nut runner motor 44. The rotating shaft 46 of the nut runner motor 44 which is a servomotor, or the like, extends in a direction parallel to the arrow D direction.

The nut runner motor 44 is provided with a torque sensor 48 and a rotation sensor 50.

By the rotating shaft 46 of the nut runner motor 44 being rotated, the socket 51 rotates via the spline bearing 32 and the gears 34, 36, and the lock nut 134 engaging with the engaging section 52 of the socket 51 can be fastened or loosened.

Meanwhile, a screwdriver (a bit) 56, which is a rotating shaft of an electric driver motor 54 and extends in the D direction, is loosely fitted, with a gap, to an inner ring of the rolling bearing 30. By rotation of the electric driver motor 54, the screwdriver 56 is able to advance/retract in the D direction (the axial direction of the adjusting screw 122) while rotating.

A tip of the screwdriver 56 is engagingly attached to a head 123 of the adjusting screw 122.

The electric driver motor 54 is provided with a torque sensor 58 and a rotation sensor 60.

Thus, by the screwdriver 56 being rotationally driven by the electric driver motor 54, the adjusting screw 122 alone is rotated, whereas, by rotational drive of the nut runner motor 44, the lock nut 134 alone is rotated (fastened or loosened).

Note that the control device 16 controls rotational drive of the electric driver motor 54 and the nut runner motor 44.

When the electric driver motor 54 or the nut runner motor 44 rotates, the slider 26 and the gear storage section 28 are fixed to the inclined surface of the arm section 24 of the column 22.

A laser displacement meter 62 is positioned on and fixed to an upper surface of the slider 26 in the F direction. Now, the laser displacement meter 62 functions as a length measuring sensor, a measuring unit, and so on.

Meanwhile, a thin circular columnar (thin disk-like) measuring object 64 that rotates integrally with the screwdriver 56 of the electric driver motor 54, is rotatably attached to the screwdriver 56. The measuring object 64 has a plane surface (a flat surface) 66 extending in a direction orthogonal to the axial direction of the screwdriver 56 (the F direction orthogonal to the D direction).

The measuring object 64 (the plane surface 66) moves integrally with the screwdriver 56 in the D direction, with movement in the axial direction due to rotation of the screwdriver 56 (with movement in the axial direction of the adjusting screw 122).

In this case, the displacement meter 62 fixed to the slider 26 irradiates the measuring object 64 (the plane surface 66) with a laser light L to measure (actually measure) with high precision a movement amount in the arrow D direction, in other words, both directions in the axial direction of the adjusting screw 122, based on a reflected laser light of the measuring object 64 (the plane surface 66).

The control device 16 is a computing machine that includes, for example, a CPU (a processor), a memory connected to the CPU, and a timer as a clocking section. By the CPU executing a program recorded in the memory, the control device 16 controls the slider 26, the nut runner motor 44, the electric driver motor 54, and the displacement meter 62, and controls the tappet clearance setting device 10 in such a manner that a tappet clearance C between the end surface 124 of the adjusting screw 122 and the valve stem end 120 attains a prescribed clearance Cs.

In this case, by the CPU executing the program, the control device 16 functions as a return rotation starting unit 72, a return movement amount calculating unit 74, a return rotation ending unit 76, and the like, as will be mentioned later.

[Regarding Tappet Clearance (Movement of Rocker Arm)]

Figure 2A:
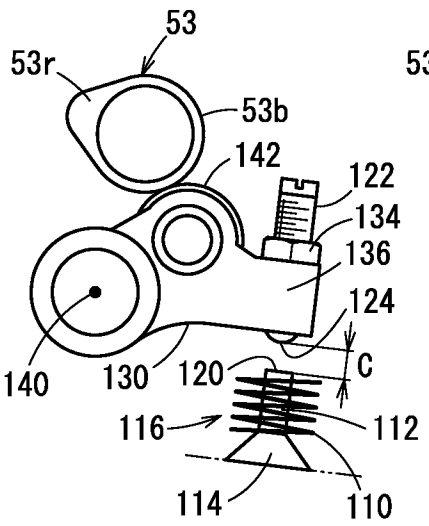
FIG. 2A is a schematic view showing a clearance in image form.

As shown in FIG. 2A, the tappet clearance (hereafter, also simply referred to as clearance) C in image form represents a gap between the end surface 124 of the adjusting screw 122, and the valve stem end 120, in a state where the roller 142 of the rocker arm 130 and a cam circle 53*b* of the cam 53 have come into contact when the valve 116 is closed.

Figure 2B:
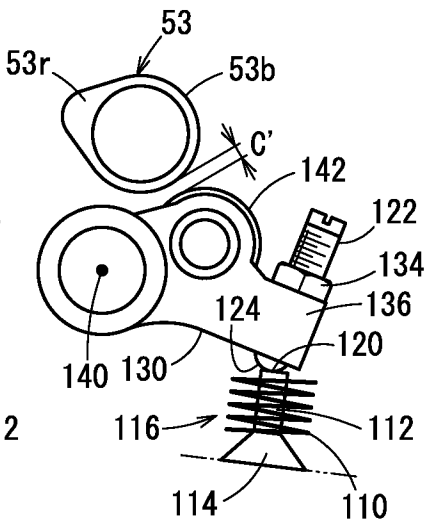
FIG. 2B is a schematic view showing an actual clearance.

However, in reality, as shown in FIG. 2B, the acting end 136 of the rocker arm 130 hangs down due to own weight of the rocker arm 130 so that the end surface 124 of the adjusting screw 122 and the valve stem end 120 attain an abutted state, hence a clearance C' (where C'<C, C' is a value proportional to C) occurs between the cam circle 53*b* and the roller 142. In this case, the clearance C between the end surface 124 of the adjusting screw 122 and the valve stem end 120 is in a state of C=0.

Figure 2C:
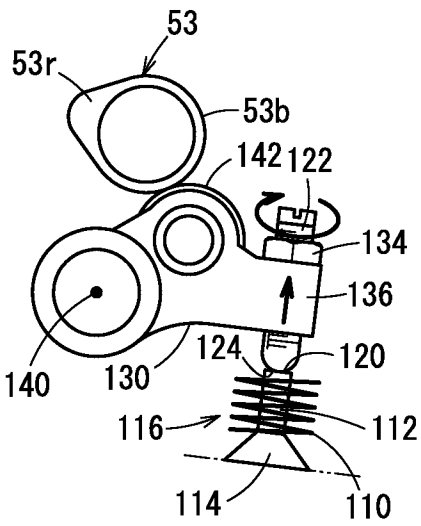
FIG. 2C is a schematic view showing a state where clearance is zero.

If the adjusting screw 122 is normally rotated (fed in) from a state where these clearances C, C' satisfy C=0 and C'>0, then, as shown in FIG. 2C, while a compressive force of the valve spring 110 is greater than a pressing torque of the adjusting screw 122, the acting end 136 of the rocker arm 130 simply rises in the axial direction of the adjusting screw 122 until the clearance C' attains C'=0.

Figure 2D:
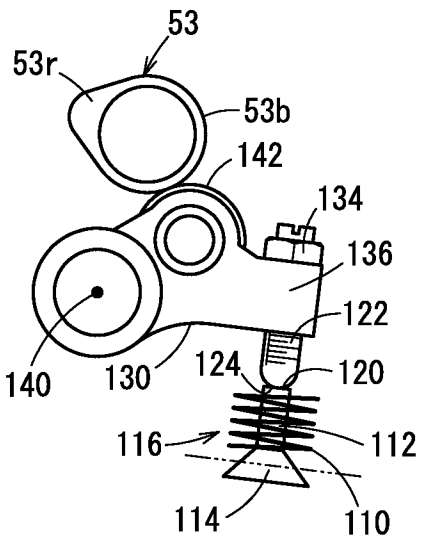
FIG. 2D is a schematic view showing a state where a valve spring starts contracting and deforming whereby a valve lowers.

If the adjusting screw 122 is further normally rotated, and the pressing torque of the adjusting screw 122 exceeds the compressive force of the valve spring 110, then, as shown in FIG. 2D, the valve spring 110 starts contracting and deforming whereby the valve stem 112 lowers, that is, the valve 116 opens.

Note that the cam 53 comprises, in addition to the cam circle 53*b* being a circular arc portion, a cam nose 53*r* being a projection and opening the valve 116 via the rocker arm 130.

[Operation]

Next, operation by the control device 16 of the tappet clearance setting device 10 implementing the method of setting tappet clearance according to the embodiment, will be described with reference to the step schematic view of FIG. 3 and the waveform diagram of FIG. 4.

Figure 4:
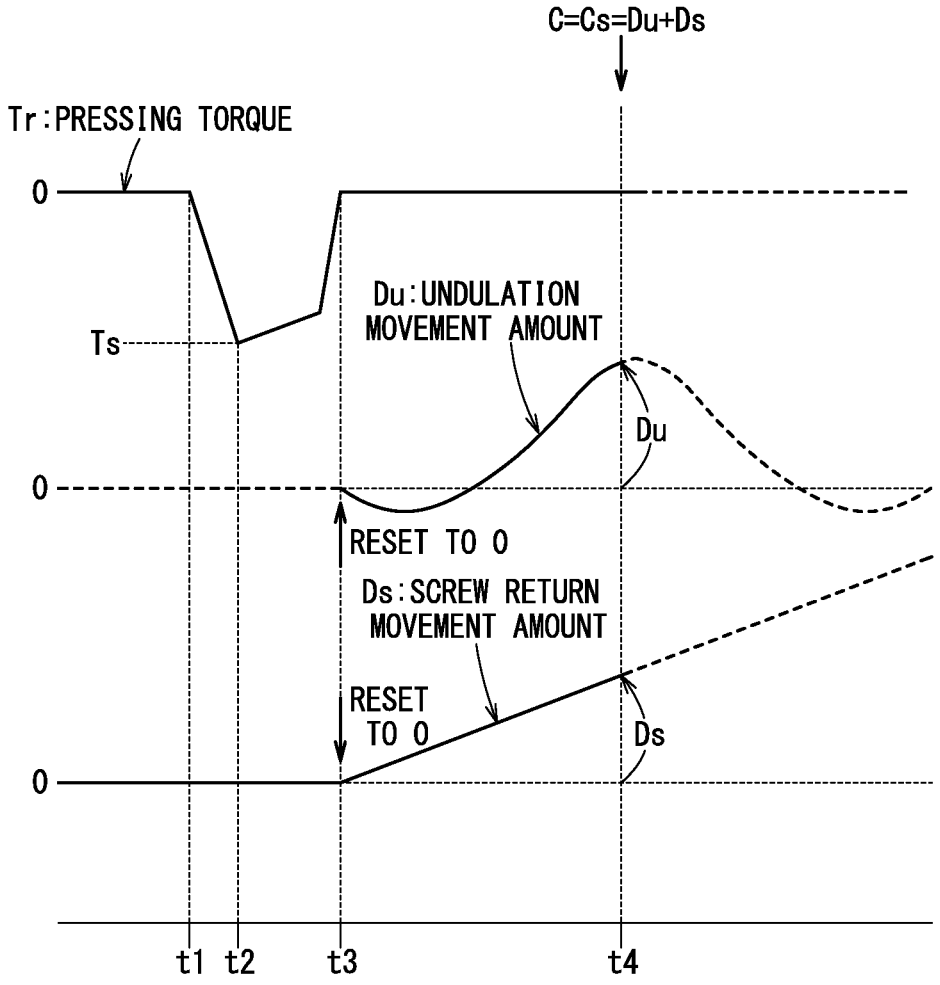
FIG. 4 is a waveform diagram provided for explanation of operation of the tappet clearance setting device.

In the waveform diagram of FIG. 4, the upper waveform indicates a pressing (feeding-in) torque Tr on the adjusting screw 122 measured by the torque sensor 58 of the electric driver motor 54. A downward direction from a 0 value indicates a direction in which the pressing torque increases.

The middle undulating waveform, which is an actual measured value by the displacement meter 62, indicates an undulation movement amount Du (a movement amount in both directions in the D direction) associated with rotation of the adjusting screw 122 between the valve stem end 120 and the end surface (contact surface) 124 of the adjusting screw 122 in the abutted state. The undulation movement amount Du is observed and stored by the control device 16.

The lower waveform indicates a screw return movement amount Ds (a calculated value) in the axial direction of the adjusting screw 122 calculated as shown in following expression (1) from a screw pitch p and a rotation return angle θ of the adjusting screw 122, calculated by the return movement amount calculating unit 74 of the control device 16.

$$Ds=p\times\theta/360° \quad (1)$$

Figure 3:
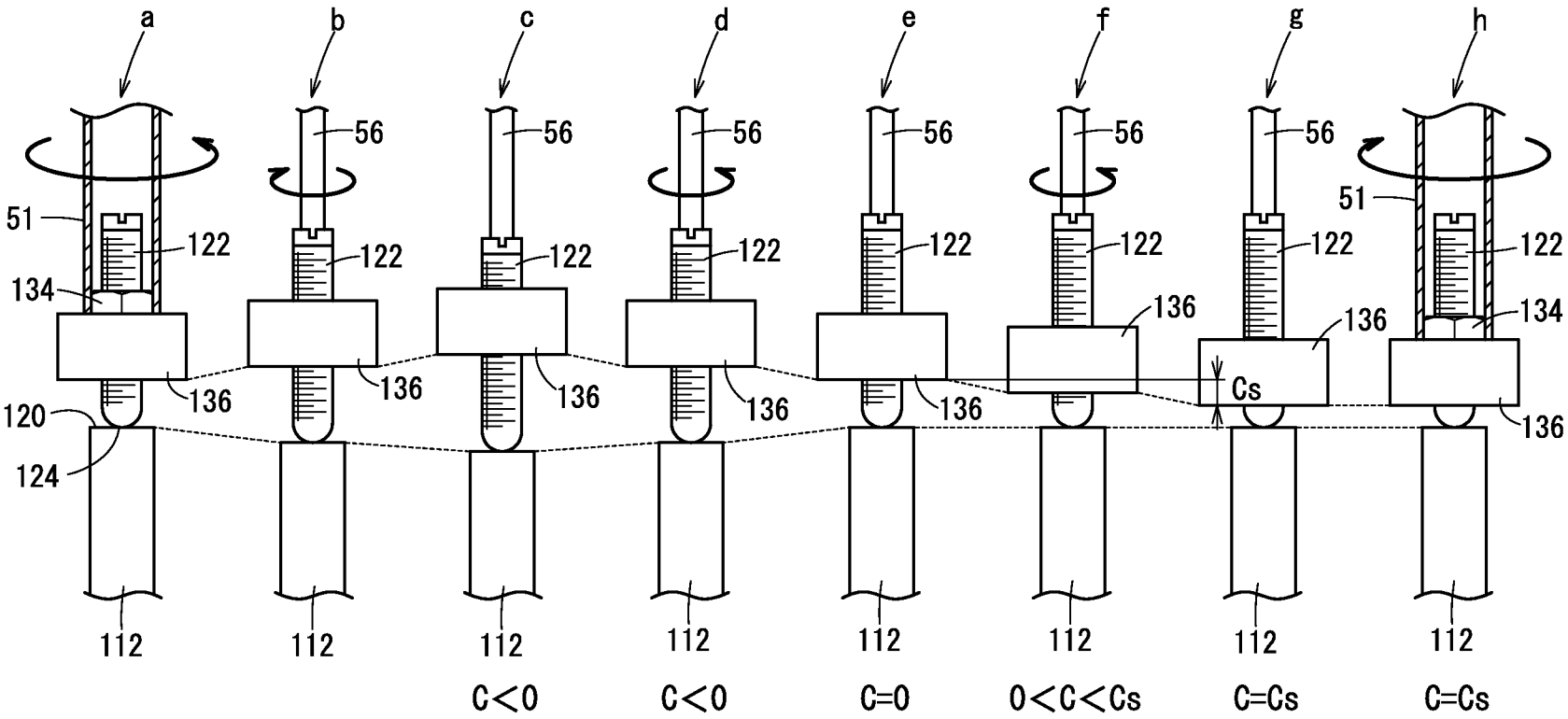
FIG. 3 is a schematic view provided for explanation of steps of the tappet clearance setting method.

Accordingly, first, in a nut loosening step a shown in FIG. 3, the control device 16 drives the slider 26 with a position of the socket 51 of the tappet clearance setting device 10 matched to the lock nut 134 of the adjusting screw 122 of the engine E that has been set on the engine conveying stand 20, and, at a position where the socket 51 has been outwardly inserted, rotates the nut runner motor 44 in a reverse rotation direction to thereby loosen the lock nut 134. In following steps from step b to step g, illustration of the lock nut 134 will be omitted to avoid complication.

Next, in a normal rotation driving-in step b, from a state where the rocker arm 130 has hung down by its own weight shown in FIG. 2B, the control device 16 feeds in the adjusting screw 122 by normally rotating the adjusting screw 122, via the screwdriver 56, by the electric driver motor 54 from time point t1 (FIG. 4). In this case, as described with reference to FIGS. 2B and 2C, while the compressive force of the valve spring 110 is greater than the pressing torque Tr, the acting end 136 of the rocker arm 130 simply rises in the axial direction of the adjusting screw 122, as shown in FIG. 2C.

Between time point t1 and time point t2 in the normal rotation driving-in step b, when the pressing torque Tr of the adjusting screw 122 exceeds the compressive force of the valve spring 110, the valve stem 112 starts lowering, as shown in FIG. 2D.

Next, in a normal rotation driving-in stopping step c, when the pressing torque Tr becomes a reference torque Ts being a predetermined small torque (a torque at which the valve spring 110 slightly elastically deforms), normal rotation of the electric driver motor 54 is stopped, whereby rotation of the adjusting screw 122 is stopped.

At time point t3 when rotation is stopped, the tappet clearance C between the end surface 124 of the adjusting screw 122 and the valve stem end 120 is in a state of C<0 value (a state where the valve spring 110 is contracting by elastically deforming).

Next, in a first reverse rotation step (a first loosening operation step) d, at time point t2, the electric driver motor 54 is reverse-rotated to move the adjusting screw 122 in a return direction (an upward direction in the D direction).

At this time, the pressing torque Tr gradually becomes smaller than the reference torque Ts, and at time point t3, a position where the pressing torque Tr has disappeared to attain a zero value (Ts=0) is detected by the control device 16, via the torque sensor 58, in a first reverse rotation stopping step (a zero-point detection and setting step) e.

In this first reverse rotation stopping step (zero-point detection and setting step) e, in other words, at a position where the end surface 124 of the adjusting screw 122 is abutting on the valve stem end 120 due to weight of the rocker arm 130 on the acting end 136 side, and the pressing torque Tr on the valve stem end 120 has a zero value, the return rotation starting unit 72 of the control device 16 resets the undulation movement amount Du being an actual measured value by the displacement meter 62 to a zero value, and resets the screw return movement amount Ds of the adjusting screw 122 to a zero value. That is, the clearance C between the end surface 124 of the adjusting screw 122 and the valve stem end 120 is set to 0 value. Then, in a second reverse rotation step (a clearance setting step) f, the control device 16 reverse-rotationally drives the electric driver motor 54 to reverse-rotate the screwdriver 56, and during this reverse rotation, the return movement amount calculating unit 74 of the control device 16 continuously calculates (calculates in real time) the clearance C being a total movement amount of the continuously detected (real-time-detected) undulation movement amount Du and the continuously calculated (real-time-calculated) screw return movement amount Ds shown in previously described expression (1), as shown in following expression (2).

$$C=Du+Ds \quad (2)$$

Now, the undulation movement amount Du is an actual measured value by the displacement meter 62 by which an amount of up and down movement, from the valve stem end 120, of the end surface 124 of the adjusting screw 122 during rotation (an amount of movement in both directions in the axial direction of the adjusting screw 122) caused by distortion or the like of the end surface 124 of the adjusting screw 122, is detected as a displacement of the measuring object 64 rotating integrally with the screwdriver 56 and moving in both directions in the D direction. It should be noted that in this case, the end surface 124 of the adjusting screw 122 is continuing the state of abutting on the valve stem end 120.

In this way, in the second reverse rotation step (the clearance setting step) f in which the displacement meter 62 continuously measures the undulation movement amount Du, and the return movement amount calculating unit 74 continuously calculates the screw return movement amount Ds based on the screw pitch p in a return direction in the axial direction of the adjusting screw 122 and on the rotation return angle θ, and, furthermore, continuously calculates the clearance C being the total movement amount, the return rotation ending unit (a return rotation monitoring unit) 76, at the same time, continuously compares magnitudes of the total movement amount C and the prescribed clearance Cs, during the second reverse rotation step (the clearance setting step) f.

In a second reverse rotation stopping step (a return rotation ending step, a prescribed clearance setting ending step) g, at time point t4 when the clearance C corresponding to the total movement amount of the continuously acquired undulation movement amount Du and screw return movement amount Ds has attained the prescribed clearance Cs (C=Cs=Ds+Du), the return rotation ending unit 76 of the control device 16 ends return rotation (reverse rotation) of the adjusting screw 122 that is performed via the screwdriver 56 by the electric driver motor 54.

As shown in FIG. 4, at time point t4, the tappet clearance C is set (adjusted) to the prescribed clearance Cs (Cs=Ds+Du).

Figure 5:
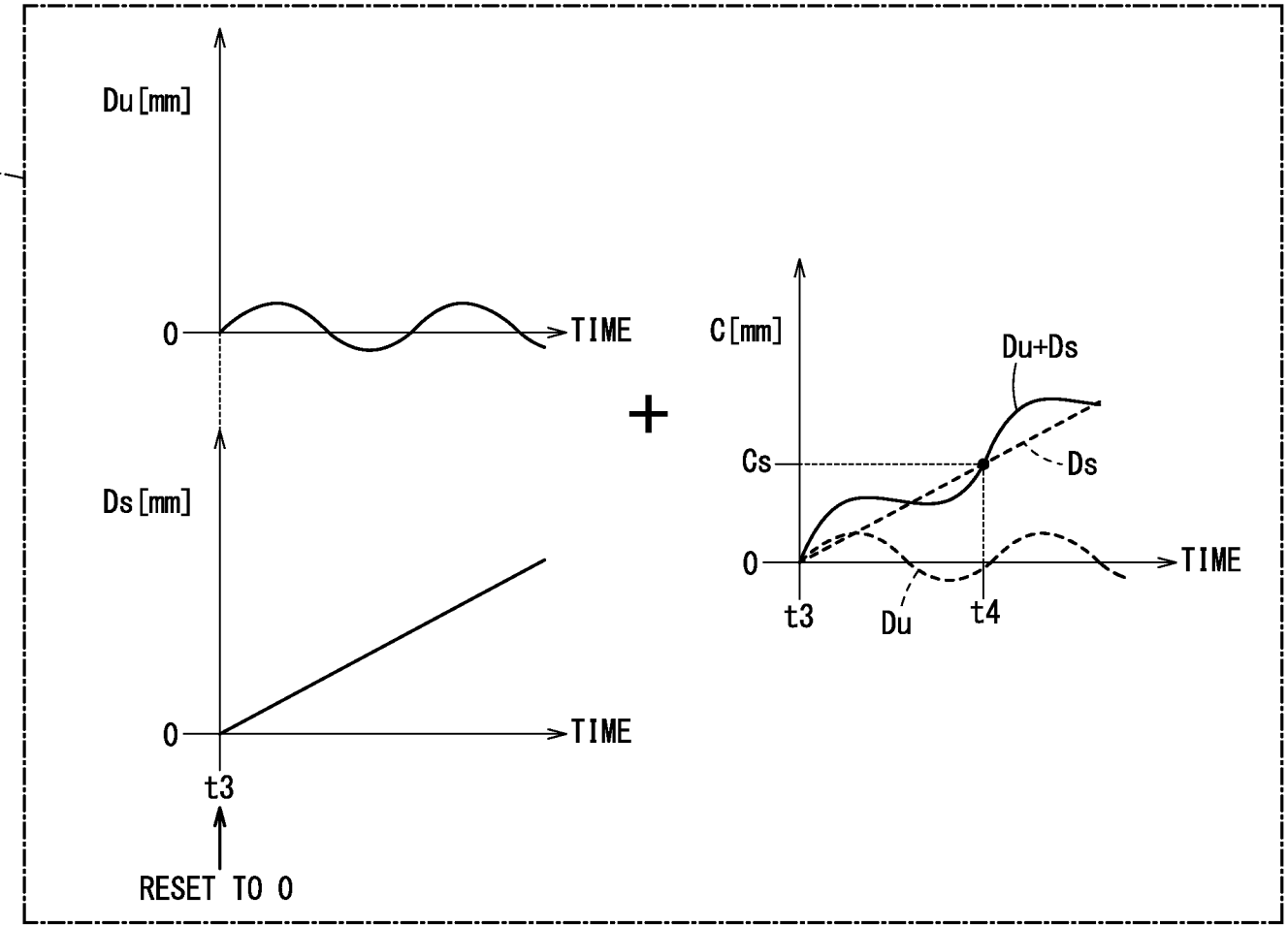
FIG. 5 is a schematic explanatory diagram of main processing of the tappet clearance setting device.

FIG. 5 is a schematic explanatory diagram of main processing of the tappet clearance setting device 10 comprising the control device 16, up until the clearance C from start time point t3 of the second reverse rotation step (the clearance setting step) f to end time point t4 of the second reverse rotation stopping step (the return rotation ending step, the prescribed clearance setting ending step) g, is set to the prescribed clearance Cs.

In FIG. 5, from time point t3 when the tappet clearance C has been reset to C=0 onward, the undulation movement amount Du measured by the displacement meter 62 and the screw return movement amount Ds based on the screw pitch p in a return direction in the axial direction of the adjusting screw 122 and on the rotation return angle θ are continuously calculated, and the clearance C (C=Du+Ds) being the total movement amount is also continuously calculated and, at time point t4 when the clearance C being the total movement amount has attained the prescribed clearance Cs, rotation of the adjusting screw 122 is stopped, whereby the clearance (the tappet clearance) C is set to the prescribed clearance Cs.

Returning to FIG. 3, in a nut fastening step h after the clearance C has been set to the prescribed clearance Cs, the control device 16 rotates the nut runner motor 44 in a predetermined direction, with the position of the socket 51 matched to the lock nut 134 of the adjusting screw 122, whereby the lock nut 134 is fastened with a prescribed torque (measured by the torque sensor 48), and the position of the adjusting screw 122 is thereby fixed at a position of the prescribed clearance Cs.

[Inventions Comprehensible from Embodiment]

Now, inventions comprehensible from the above-described embodiment will be described below. Note that although, for convenience of understanding, constituent elements are assigned with the symbols used in the above-described embodiment, the constituent elements are not limited to those assigned with those symbols.

The method of setting tappet clearance according to the present invention is a method of setting tappet clearance by which a tappet clearance C between an end surface 124 of an adjusting screw 122 screwed into an acting end 136 of a rocker arm 130, and a valve stem end 120, is set to a prescribed clearance Cs, the method including: a step d of starting return rotation of the adjusting screw 122 from a position where the end surface 124 of the adjusting screw 122 is abutting on the valve stem end 120 due to weight of the rocker arm 130 on the acting end 136 side, and a pressing torque Tr on the valve stem end 120 has a zero value, the return rotation being started in a state where the abutting is being continued; a step f of, when rotation is being returned in the state where the abutting is being continued, continuously measuring, as an undulation movement amount Du, movement of the end surface 124 of the adjusting screw 122 in both directions in an axial direction of the adjusting screw 122 due to undulation, and continuously calculating, as a screw return movement amount Ds, movement based on a screw pitch p in a return direction in the axial direction of the adjusting screw 122 and on a rotation return angle θ; and a step g of ending the return rotation of the adjusting screw 122 when a total movement amount (Du+Ds) of the undulation movement amount Du and the screw return movement amount Ds that have been continuously acquired has attained the prescribed clearance Cs.

Thus, a configuration has been adopted whereby, even in the case where, due to distortion or the like of the end surface 124 of the adjusting screw 122 abutting on the valve stem end 120, there exists a non-linear undulation movement amount Du in a movement amount of the end surface 124 of the adjusting screw 122 from a position where pressing torque Tr of the adjusting screw 122 is zero, with respect to the rotation return angle θ of the adjusting screw 122, the undulation movement amount Du is continuously measured, and the screw return movement amount Ds based on the screw pitch p of the adjusting screw 122 and on the rotation return angle θ is continuously calculated, and, when the total movement amount (Du+Ds) of the undulation movement amount Du being measured and the screw return movement amount Ds being calculated has attained the prescribed clearance Cs, the return rotation is ended. Therefore, the tappet clearance C can be set to the prescribed clearance Cs in a short time, easily, accurately, and reliably.

In this case, preferably, when movement of the end surface 124 of the adjusting screw 122 in both directions in the axial direction of the adjusting screw 122 due to undulation is continuously measured as the undulation movement amount Du, an amount of movement of a screwdriver 56 in an axial direction thereof is continuously measured, the screwdriver 56 return-rotating the adjusting screw 122.

With this configuration, since the screwdriver 56 rotates integrally with the adjusting screw 122 during the return rotation, the undulation movement amount Du can be easily measured by continuously measuring the movement amount of the screwdriver 56 in the axial direction thereof.

Note that when the screwdriver 56 is being return-rotated by a motor 54, the undulation movement amount Du may be measured based on output of a rotation sensor 60 provided to the motor 54.

The undulation movement amount Du can be easily and highly precisely measured at low cost, by the rotation sensor 60 provided to the motor 54.

Moreover, more preferably, a measuring object 64 that has a plane surface 66 extending in a direction orthogonal to the axial direction of the screwdriver 56 and rotates integrally with the screwdriver 56 is attached to the screwdriver 56, and an amount of movement of the plane surface 66 of the measuring object 64 in a normal direction thereof associated with return rotation of the screwdriver 56 is measured by a length measuring sensor 62 and determined as the undulation movement amount Du.

With this configuration, the undulation movement amount Du can be measured even more accurately by the length measuring sensor 62.

In this case, the length measuring sensor 62 may be configured to be a laser displacement meter.

The tappet clearance setting device 10 according to the present invention is a tappet clearance setting device 10 by which a tappet clearance C between an end surface 124 of an adjusting screw 122 screwed into an acting end 136 of a rocker arm 130, and a valve stem end 120, is set to a prescribed clearance Cs, the tappet clearance setting device 10 including: a screwdriver 56 capable of rotating the adjusting screw 122; a return rotation starting unit 72 configured to start return rotation of the adjusting screw 122 by the screwdriver 56, from a position where the end surface 124 of the adjusting screw 122 is abutting on the valve stem end 120 due to weight of the rocker arm 130 on the acting end 136 side, and a pressing torque Tr on the valve stem end 120 has a zero value, the return rotation being started in a state where the abutting is being continued; a measuring unit 62 configured to, when rotation is being returned in the state where the abutting is being continued, continuously measure, as an undulation movement amount Du, movement of the end surface 124 of the adjusting screw 122 in both directions in an axial direction of the adjusting screw 122 due to undulation; a return movement amount calculating unit 74 configured to continuously calculate, as a screw return movement amount Ds, movement based on a screw pitch p in a return direction in the axial direction of the adjusting screw 122 and on a rotation return angle θ; and a return rotation ending unit 76 configured to end the return rotation of the adjusting screw 122 when a total movement amount (Du+Ds) of the undulation movement amount Du and the screw return movement amount Ds that have been continuously acquired has attained the prescribed clearance Cs.

Thus, a configuration has been adopted whereby, even in the case where, due to distortion or the like of the end surface 124 of the adjusting screw 122 abutting on the valve stem end 120, there exists a non-linear undulation movement amount Du in a movement amount of the end surface 124 of the adjusting screw 122 from a position where pressing torque Tr of the adjusting screw 122 is zero, with respect to the rotation return angle θ of the adjusting screw 122, the undulation movement amount Du is continuously measured, and the screw return movement amount Ds based on the screw pitch p of the adjusting screw 122 and on the rotation return angle θ is continuously calculated, and, when the total movement amount (Du+Ds) of the undulation movement amount Du being measured and the screw return movement amount Ds being calculated has attained the prescribed clearance Cs, the return rotation is ended. Therefore, the tappet clearance C can be set to the prescribed clearance Cs in a short time, easily, accurately, and reliably.

Note that the present invention is not limited to the above-mentioned embodiment, and it goes without saying that a variety of configurations, such as, for example, replacing the displacement meter 62 such as a laser displacement meter being a non-contact type displacement meter, with a contact type displacement meter whose probe contacts the plane surface 66 of the measuring object 64, may be adopted based on described content of the present specification.

What is claimed is:

1. A method of setting tappet clearance by which a tappet clearance between an end surface of an adjusting screw screwed into an acting end of a rocker arm, and a valve stem end, is set to a prescribed clearance, the method comprising:

starting a return rotation of the adjusting screw from a position where the end surface of the adjusting screw is abutting on the valve stem end due to a weight of the acting end of the rocker arm, and a pressing torque on the valve stem end has a zero value, wherein the end surface continuously abuts the valve stem end during the return rotation;

during the return rotation, continuously measuring an undulation movement amount defined as an oscillating movement of the adjusting screw in an axial direction of the adjusting screw due to a processing distortion of the end surface at a point of contact with the valve stem end as the adjusting screw rotates, and continuously calculating a screw return movement amount defined as a movement of the adjusting screw in the axial direction based on a screw pitch and a rotation return angle of the adjusting screw during the return rotation; and ending the return rotation when a sum of the undulation movement amount and the screw return movement amount reaches the prescribed clearance.

2. The method of setting tappet clearance according to claim 1, wherein the return rotation is executed via a screwdriver, and the undulation movement amount is measured at the screwdriver.

3. The method of setting tappet clearance according to claim 2, wherein the screwdriver is driven by a motor, and the undulation movement amount is measured based on an output of a rotation sensor of the motor.

4. The method of setting tappet clearance according to claim 2, wherein the screwdriver comprises a measuring object configured to rotate integrally with the screwdriver, the measuring object including a plane surface extending orthogonal to the axial direction, and the undulation movement amount is measured based on an amount of movement of the plane surface in the axial direction as measured by a length measuring sensor.

5. The method of setting tappet clearance according to claim 4, wherein the length measuring sensor is a laser displacement meter.

6. A device that sets tappet clearance by which a tappet clearance between an end surface of an adjusting screw screwed into an acting end of a rocker arm, and a valve stem end, is set to a prescribed clearance, the device comprising:

a screwdriver configured to rotate the adjusting screw;

a return rotation starting unit configured to start a return rotation of the adjusting screw via the screwdriver, from a position where the end surface of the adjusting screw is abutting on the valve stem end due to a weight of the acting end of the rocker arm, and a pressing torque on the valve stem end has a zero value, wherein the end surface continuously abuts the valve stem end during the return rotation;

a measuring unit configured to, during the return rotation, continuously measure an undulation movement amount defined as an oscillating movement of the adjusting screw in an axial direction of the adjusting screw due to a processing distortion of the end surface at a point of contact with the valve stem end as the adjusting screw rotates;

a return movement amount calculating unit configured to continuously calculate a screw return movement amount defined as a movement of the adjusting screw in the axial direction based on a screw pitch and a rotation return angle of the adjusting screw during the return rotation; and a return rotation ending unit configured to end the return rotation when a sum of the undulation movement amount and the screw return movement amount reaches the prescribed clearance.

7. The device that sets tappet clearance according to claim 6, further comprising an electric driver motor configured to rotate the screwdriver, the electric driver motor including a rotation sensor, wherein the undulation movement amount is measured at the screwdriver via the rotation sensor.

8. The device that sets tappet clearance according to claim 6, further comprising a length measuring sensor, wherein the screwdriver comprises a measuring object configured to rotate integrally with the screwdriver, the measuring object including a plane surface extending orthogonal to the axial direction, and the undulation movement amount is measured based on an amount of movement of the plane surface in the axial direction as measured by the length measuring sensor.

9. The device that sets tappet clearance according to claim 8, wherein the length measuring sensor is a laser displacement meter.

* * * * *